US007021995B2

(12) United States Patent
Toge et al.

(10) Patent No.: US 7,021,995 B2
(45) Date of Patent: Apr. 4, 2006

(54) CMP PAD CONDITIONER HAVING WORKING SURFACE INCLINED IN RADIALLY OUTER PORTION

(75) Inventors: Naoki Toge, Kurume (JP); Yasuaki Inoue, Kurume (JP)

(73) Assignees: Noritake Co., Limited, Nagoya (JP); Noritake Super Abrasive Co., Ltd., Kurume (JP)

( * ) Notice: Subject to any disclaimer, the term of this patent is extended or adjusted under 35 U.S.C. 154(b) by 0 days.

(21) Appl. No.: 11/075,749

(22) Filed: Mar. 10, 2005

(65) Prior Publication Data

US 2005/0215188 A1 Sep. 29, 2005

(30) Foreign Application Priority Data

Mar. 16, 2004 (JP) ..... 2004-074671

(51) Int. Cl.
*B24B 1/00* (2006.01)

(52) U.S. Cl. ..... 451/56; 451/443; 451/548; 451/527

(58) Field of Classification Search ..... 451/56, 451/443, 444, 548, 359, 526, 527, 530, 533
See application file for complete search history.

(56) References Cited

U.S. PATENT DOCUMENTS 4,918,872 A * 4/1990 Sato et al. ..... 451/548
5,060,424 A * 10/1991 Sato et al. ..... 451/548
6,106,371 A * 8/2000 Nagahara et al. ..... 451/56
6,325,709 B1 * 12/2001 Nanda et al. ..... 451/443
6,682,405 B1 * 1/2004 Shimokawa ..... 451/56
6,852,016 B1 * 2/2005 Henderson ..... 451/56
6,926,598 B1 * 8/2005 Toge et al. ..... 451/540

FOREIGN PATENT DOCUMENTS

| | | | |
|---|---|---|---|
| DE | 315859 | * | 5/1989 |
| JP | 05023956 | * | 2/1993 |
| JP | A 2001-113456 | | 4/2001 |
| JP | A 2001-287150 | | 10/2001 |

* cited by examiner

*Primary Examiner*—Eileen P. Morgan
(74) *Attorney, Agent, or Firm*—Oliff & Berridge, PLC

(57) ABSTRACT

A CMP pad conditioner including: (a) a disk-shaped substrate having a working surface which is provided by one of its axially opposite end surfaces and which is to be brought into contact with the CMP pad; and (b) abrasive grains which are fixed to the working surface. The substrate includes a radially inner portion and a radially outer portion which is located radially outwardly of the radially inner portion. The working surface in the radially outer portion is inclined with respect to the working surface in the radially inner portion, such that a thickness of the radially outer portion as measured in an axial direction of the substrate is reduced as viewed in a direction away from an axis of the substrate toward a periphery of the substrate. A ratio of an outside diameter of the radially inner portion to an outside diameter of the substrate is 60–85%.

12 Claims, 3 Drawing Sheets

CMP PAD CONDITIONER HAVING WORKING SURFACE INCLINED IN RADIALLY OUTER PORTION

BACKGROUND OF THE INVENTION

1. Field of the Invention

The present invention to a CMP pad conditioner which is used for smoothing and planarizing a surface of a workpiece such as silicon wafer in a CMP apparatus.

2. Discussion of the Related Art

In recent years, as a process of smoothing and planarizing a surface of a silicon wafer or the like, there is commonly practiced a chemical mechanical polishing (herein after referred to as "CMP") process.

FIG. 3 shows a conventional CMP apparatus 51 including: a rotary table 53 which is to be rotated about its axis by a drive shaft 52; an polishing unit 54 which is disposed above the rotary table 53; a conditioning unit 55 which is disposed above the rotary table 53; and a polishing pad 56 which is formed on an upper surface of the rotary table 53.

The polishing unit 54 includes a polishing spindle head 57 and a disk-shaped wafer carrier 58 having a lower surface to which a wafer 59 as a workpiece is to be fixed. In this example illustrated in FIG. 3, the wafer 59 is sucked by the wafer carrier 58. The sucked wafer 59 can be rotated together with the wafer carrier 58, about an axis of the disk-shaped wafer carrier 58 by the polishing spindle head 57. The conditioning unit 55 includes a conditioning spindle head 60 and a conditioning disk 61 which can be rotated about its axis by the conditioning spindle head 60.

The CMP apparatus 51 further includes a slurry supplier 62 provided to supply an abrasive slurry 63 onto the polishing pad 56. In a polishing operation, the supplied slurry 63 is caught between the wafer 59 and the polishing pad 56 which are held in contact with each other. With the wafer 59 being held contact at its surface with an upper surface of the polishing pad 56 which is disposed on the upper surface of the rotary table 53, the contact surface of the wafer 59 is ground or polished by the slurry 63.

On a radially outer portion of a lower surface of the conditioning disk 61, there are fixed abrasive grains such as diamond grains. The abrasive grains fixed to the lower surface of the conditioning disk 61 are rubbed against the surface of the polishing pad 56, for dressing and truing the surface of the polishing pad 56. Thus, the surface of the polishing pad 56 is prevented from becoming compacted, and is kept suitably roughened so as to maintain its abrasive performance.

FIGS. 4A and 4B shows a conventional conditioning disk, which is principally constituted by a disk-shaped metal substrate 71 and abrasive grains 73. The metal substrate 71 includes an annular portion 72 provided by its radially outer portion. The annular portion 72 is made to protrude in an axial direction of the substrate 71, and is given a flat end surface. The abrasive grains 73 are disposed on the flat end surface of the annular portion 72, and arranged in a predetermined pattern. However, when this conventional conditioning disk is used for conditioning a polishing pad having an elasticity, the conditioning disk suffers from a problem that ones of the abrasive grains 73 located at a peripheral part of the annular portion 72 tends to be easily worn, since a large load acts on the ones of the abrasive grains 73 located at the peripheral part. In the worst case, the abrasive grains 73 at the peripheral part could be fractured or removed from the substrate 71. If the abrasive grains 73 at the peripheral part were worn out, the polishing pad no longer could be satisfactorily dressed and trued. That is, it would be impossible to sufficiently clean the pad surface and remove high spots on the pad surface. In other words, the conditioning disk could no longer serve as a conditioner. Further, if the abrasive grains 73 were fractured or removed from the substrate 71, the fractured or removed grains left on the pad surface could cause the workpiece to be scratched, so that the polishing operation would have to be suspended.

JP-A-2001-113456 and JP-A-2001-287150 (publications of unexamined Japanese Patent Applications laid open in 2001) discloses CMP pad conditioners having respective arrangements designed for solving the above-described problems. In either of the conditioners disclosed by the two Japanese publications, the disk-shaped substrate is provided by an annular body, and has a working surface which is provided by one of its axially opposite end surfaces. The working surface is entirely or partially defined by a part of a spherical surface, so as to be convexly curved. That is, the working surface is entirely or partially provided by a convexly curved surface having a predetermined radius of curvature as measured in an axial cross section of the disk-shaped substrate. Since the working surface is entirely or partially provided by the convexly curved surface, it is possible to reduce a load acting on the abrasive grains located in a peripheral or radially outer portion of the substrate. However, since the flat or non-curved portion of the working surface is narrow, the conditioner cannot perform a conditioning operation at a high efficiency. Further, since the abrasive grains located on a relatively outer portion of the working surface of the disk-shaped substrate tend to be worn earlier than those located on a relatively inner portion of the working surface of the substrate, the pad is likely to suffer from a wear in a local portion of its surface, which could lead to a reduction in the pad lifetime. For avoiding the local wear of the pad surface, it might be possible to feed the conditioner on the pad surface along a denser tool path with an increased number of times of its reciprocating motions. However, feeing the conditioner along the denser path requires a larger length of time as a conditioning time, and is not therefore practicable.

SUMMARY OF THE INVENTION

The present invention was made in view of the background prior art discussed above. It is therefore an object of the invention to provide a CMP pad conditioner capable of avoiding considerable damage of abrasive grains in its peripheral or radially outer portion and conditioning evenly over an entire surface of a CMP pad without causing the surface of the CMP pad to suffer from a local wear. This object may be achieved according to any one of first through twelfth aspects of the invention which are described below.

The first aspect of the invention provides a CMP pad conditioner including (a) a disk-shaped substrate having a working surface which is provided by one of axially opposite end surfaces thereof and which is to be brought into contact with the CMP pad, and (b) abrasive grains which are fixed to the working surface. The substrate includes a radially inner portion and a radially outer portion which is located radially outwardly of the radially inner portion. The working surface in the radially outer portion is inclined with respect to the working surface in the radially inner portion, such that a thickness of the radially outer portion as measured in an axial direction of the substrate is reduced as viewed in a direction away from an axis of the substrate toward a periphery of the substrate. A ratio of ratio of an outside diameter of the radially inner portion to an outside diameter of the substrate is 60–85%.

According to the second aspect of the invention, in the conditioner defined in the first aspect of the invention, the abrasive grains are arranged in a predetermined pattern, and cooperate with each other to constitute an abrasive monolayer. The abrasive grains are bonded to the working surface of the disk-shaped substrate through a braze material including an active metal.

According to the third aspect of the invention, in the conditioner defined in the second aspect of the invention, the disk-shaped substrate is provided by an annular body. A ratio of an inside diameter of the radially inner portion to the outside diameter of the substrate is not larger than 45%.

According to the fourth aspect of the invention, in the conditioner defined in any one of the first through third aspects of the invention, the working surface in the radially inner portion is parallel with a plane perpendicular to the axial direction of the disk-shaped substrate, such that a thickness of the radially inner portion as measured in the axial direction is substantially constant.

According to the fifth aspect of the invention, in the conditioner defined in the fourth aspect of the invention, the thickness of the radially inner portion of the disk-shaped substrate is larger than a thickness of a radially outer end of the disk-shaped substrate as measured in the axial direction, by a predetermined difference amount. A ratio of the predetermined difference amount to an average size of the abrasive grains is 70–150%.

According to the sixth aspect of the invention, in the conditioner defined in any one of the first through fifth aspects of the invention, the disk-shaped substrate further includes a radially intermediate portion which is interposed between the radially inner and outer portions in a radial direction of the disk-shaped substrate. The working surface in the radially intermediate portion is provided by a curved surface which has a radius of curvature of at least 1 mm as measured in an axial cross section of the disk-shaped substrate.

According to the seventh aspect of the invention, in the conditioner defined in the sixth aspect of the invention, the working surface in the radially outer portion of the disk-shaped substrate is provided by another curved surface which has a radius of curvature that is larger than the radius of curvature of the curved surface providing the working surface in the radially intermediate portion.

According to the eighth aspect of the invention, in the conditioner defined in the seventh aspect of the invention, the radius of curvature of the another curved surface providing the working surface in the radially outer portion is larger than the outside diameter of the disk-shaped substrate.

According to the ninth aspect of the invention, in the conditioner defined in any one of the first through eighth aspects of the invention, the abrasive grains fixed to the working surface of the disk-shaped substrate cooperate with each other to constitute an abrasive layer. The abrasive layer is divided into a plurality of segments by a plurality of slots or grooves which are formed to extend along the working surface.

According to the tenth aspect of the invention, in the conditioner defined in the ninth aspect of the invention, the plurality of grooves includes first grooves each of which extends substantially in a circumferential direction of the disk-shaped substrate, and second grooves each of which extends in a direction away from the axis of the substrate toward the periphery of the substrate.

According to the eleventh aspect of the invention, in the conditioner defined in the tenth aspect of the invention, the conditioner being rotated about the axis in a predetermined rotating direction for conditioning the CMP pad. Each of the second grooves is inclined with respect to a radial direction of the disk-shaped substrate, such that a radially outer end of each the second grooves is positioned on a rear side of a radially inner end of the each of the second grooves as viewed in the rotating direction.

According to the twelfth aspect of the invention, in the conditioner defined in the eleventh aspect of the invention, each of the second grooves is curved such that a degree of inclination thereof with respect to the radial direction is gradually increased as viewed in the direction away from the axis of the disk-shaped substrate toward the periphery of the substrate.

In the conditioner defined in any one of the first through twelfth aspects of the invention, in which the ratio of the outside diameter of the radially inner portion to the outside diameter of the disk-shaped substrate is 60–85%, it is possible to substantially avoid concentration of load onto ones of the abrasive grains located in the radially outer portion of the substrate, thereby preventing wear and fracture of the ones of the abrasive grains located in the radially outer portion, and leading to increase in lifetime of the conditioner. Further, since the wear and fracture of the abrasive grains are thus prevented, it is possible to maintain flatness in the profile of the CMP pad and prevent any local wear in the surface of the CMP, thereby enabling the CMP pad to exhibit an increased polishing rate and to have a prolonged lifetime. Still further, since the flatness in the profile of the CMP pad is thus maintained, a thickness of abrasive slurry (that is to be interposed between the CMP pad and the workpiece) can be made constant, thereby making it possible to significantly reduce micro-scratches given in the workpiece.

If the above-described ratio of the outside diameter of the radially inner portion to the outside diameter of the substrate is lower than 60%, the number of ones of the abrasive grains, which are likely to work for conditioning the CMP pad, is made excessively small. The reduction in the number of the working abrasive grains leads to reduction in a pad cut rate and a lifetime of the conditioner. If the above-described ratio is higher than 85%, it is impossible to sufficiently reduce the load acting on each of the ones of the abrasive grains located in the radially outer portion of the substrate. That is, it is not possible to sufficiently reduce a possibility of damage of each abrasive grains located in the radially outer portion of the substrate. It is noted that the term "pad cut rate" may be interpreted to mean an amount of stock which can be cut or removed from the CMP pad by the conditioner for a predetermined length of time, and that the term "polishing rate" may be interpreted to mean an amount of stock which can be cut or removed from a workpiece (e.g., wafer) by the CMP pad and the abrasive slurry for a predetermined length of time.

In the conditioner defined in the fifth aspect of the invention, in which the ratio of the difference between the radially inner and outer portions in thickness with respect to the average size of the abrasive grains is 70–150%, it is possible to sufficiently reduce the load acting to each of the ones of the abrasive grains located in the radially outer portion, and to obtain a sufficiently large number of the ones of the abrasive grains, which are likely to work for the conditioning of the CMP pad. If the above-described ratio is lower than 70%, the load acting on each abrasive grain located in the radially outer portion is made excessively large. If the ratio is higher than 150%, the number of the working ones of the abrasive grains is made excessively small. It is noted that the average size of the abrasive grains may be obtained on the basis of a grain size distribution which is commonly measured in accordance with a known method such as Laser Diffraction method, Coulter Counter method and Sedimentation method.

In the conditioner defined in any one of the sixth through eighth aspects of the invention, in which the working surface in the radially intermediate portion is provided by the curved surface having the radius of curvature of at least 1 mm, it is possible to sufficiently reduce the load acting on each of ones of the abrasive grains located in the radially intermediate portion. If the radius of curvature of the curved surface providing the radially intermediate portion is smaller than 1 mm, the load acting on each abrasive grain located in the radially intermediate portion is made excessively large.

In the conditioner defined in any one of the ninth through twelfth aspects of the invention, since the abrasive layer formed on the working surface of the substrate is divided into the plurality of abrasive segments by the plurality of slots or grooves, the conditioning performance can be further improved owing to the grooves which facilitates evacuation of swarf (small chips and removed abrasive grains) from the conditioning area therethrough and also introduction of the abrasive slurry into the conditioning area therethrough.

In the conditioner defined in the eleventh or twelfth aspect of the invention, since the above-described grooves including the grooves each of which is inclined with respect to the radial direction of the disk-shaped substrate such that the radially outer end of the inclined groove is positioned on the rear side of the radially inner end of the inclined groove as viewed in the rotating direction, the evacuation of the swarf through the thus inclined groove (which is caused by the rotation of the conditioner) can be made more efficiently.

BRIEF DESCRIPTION OF THE DRAWINGS

The above and other objects, features, advantages and technical and industrial significance of this invention will be better understood by reading the following detailed description of the presently preferred embodiments of the invention, when considered in connection with the accompanying drawings, in which.

DETAILED DESCRIPTION OF THE PREFERRED EMBODIMENT

Figure 1:
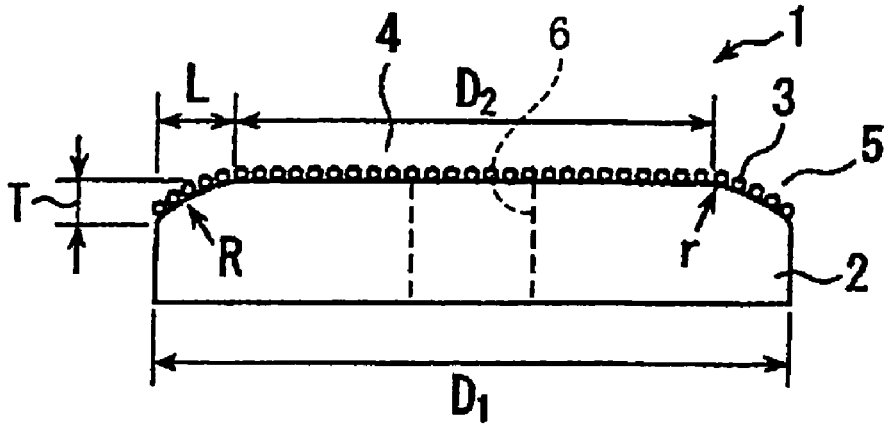
FIG. 1 is a view showing a configuration of a CMP pad conditioner in the form of a conditioning disk constructed according to a first embodiment of the invention.

Referring first to FIG. 1, there will be described a CMP pad conditioner in the form of a rotary conditioning disk 1 which is constructed according to a first embodiment of the invention. This conditioning disk 1 includes: a disk-shaped metal substrate 2 having a working surface which is provided by one of its axially opposite end surfaces; and abrasive grains 3 which are fixed to an entirety of the working surface of the metal substrate 2. The metal substrate 2 includes a radially inner portion 4 and a radially outer portion 5 which is located radially outwardly of the radially inner portion 4. The disk-shaped metal substrate 2 is provided by an annular body, and a center hole 6 formed therethrough. The working surface in the radially inner portion 4 is parallel with a plane perpendicular to an axial direction of the metal substrate 2, such that a thickness of the radially inner portion 4 as measured in the axial direction is substantially constant. The working surface in the radially outer portion 5 is inclined with respect to the working surface in the radially inner portion 4, such that a thickness of the radially outer portion as measured in the axial direction is reduced as viewed in a direction away from an axis of the metal substrate 2 toward a radially outer end or periphery of the metal substrate 2. While the working surface in the radially inner portion 4 is provided by a substantially flat surface, the working surface in the radially outer portion 5 is provided by a convexly curved surface which has a predetermined radius R of curvature as measured in an axial cross section of the metal substrate 2.

The abrasive grains 3 are arranged in a predetermined pattern, and cooperate with each other to constitute an abrasive monolayer. In other words, the abrasive layer composed of the abrasive grains 3 is formed on the working surface of the metal substrate 2. The abrasive grains 3 are bonded to each other and to the working surface of the metal substrate 2 by a braze material including an active metal. The thickness of the radially inner portion 4 of the metal substrate 2 is larger than a thickness of a radially outer end of the radially outer portion 5 (i.e., a thickness of a periphery of the substrate 2) as measured in the axial direction, by a predetermined difference amount T, such that a ratio of the predetermined difference amount T to an average size of the abrasive grains 3 is 70–150%.

As to specific dimensions of the conditioning disk 1, the disk-shaped metal substrate 2 has an outside diameter D1 of 100 mm, and an inside diameter D2 of not larger than 45 mm. The radially inner portion 4 of the metal substrate 2 has an outside diameter D2 of 80 mm. The radially outer portion 5 of the metal substrate 2 has a width L of 10 mm as measured in a radial direction of the metal substrate 2. The above-described difference amount T between the thickness of the radially inner portion 4 and the thickness of the radially outer end of the radially outer portion 5 is 0.15 mm. The radius R of curvature of the convexly curved surface providing the radially outer portion 3 is 333 mm.

The disk-shaped metal substrate 2 further includes a radially intermediate portion which is interposed between the radially inner and outer portions 4, 5 in the radial direction of the metal substrate 2. The working surface in the radially intermediate portion is provided by a convexly curved surface which has a radius r of curvature of 4 mm as measured in the axial cross section of the substrate 2. The working surface in the radially intermediate portion may be regarded as a transition portion of the working surface which is interposed between a flat or non-inclined portion of the working surface in the radially inner portion 4 and an inclined portion of the working surface in the radially outer portion 5. In other words, the flat or non-inclined portion and the inclined portion of the working surface are smoothly connected via the transition portion of the working surface.

Figure 2:
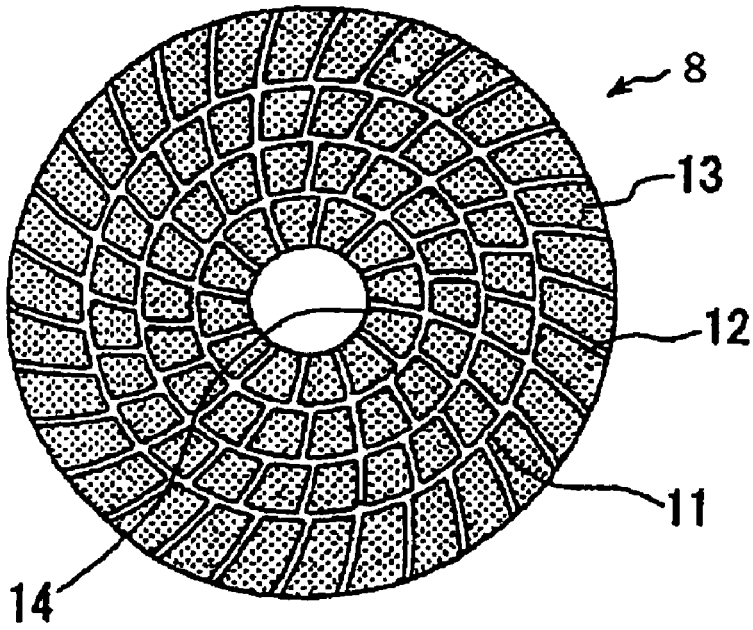
FIG. 2 is a view showing a working surface of a conditioning disk constructed according to a second embodiment of the invention.
Figure 3:
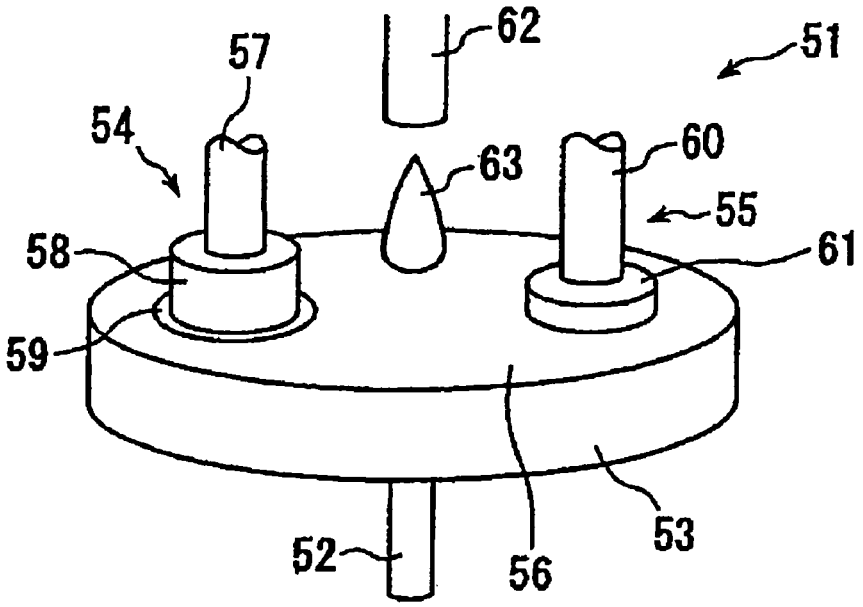
FIG.3 PRIOR ART
FIG. 3 is view showing a conventional CMP apparatus.

FIG. 2 shows another rotary conditioning disk 8, which is constructed according to a second embodiment of the invention. This rotary conditioning disk 8 is substantially identical with the above-described rotary conditioning disk 1 except that an abrasive layer 13 is divided into a plurality of segments by a plurality of slots or grooves 11, 12 which are formed to extend along the working surface of the metal substrate 2.

Described specifically, the plurality of grooves 11, 12 includes first grooves 11 each of which extends substantially in a circumferential direction of the disk-shaped metal substrate 2, and second grooves 12 each of which extends in a direction away from a center hole 14 (farmed through the metal substrate 2) toward the periphery of the metal substrate 2. Each of the second grooves 12 is inclined with respect to a radial direction of the metal substrate 2, such that a radially outer end of each second groove 12 is positioned on a rear side of a radially inner end of the second groove 12 as viewed in a rotating direction of the rotary conditioning disk 8, i.e., in the counterclockwise direction as seen in FIG. 2. Each second groove 12 is curved such that a degree of its inclination with respect to the radial direction is gradually increased as viewed in the direction away from the center hole 14 toward the periphery of the metal substrate 2. Since each second groove 12 is inclined with respect to the radial direction of the metal substrate 2 as described above, swarf can be displaced radially outwardly along the second grooves 12 while the conditioning disk 8 is being rotated. Thus, the evacuation of the swarf through the second grooves 12 can be made efficiently.

For verifying a technical effect provided by the present invention, a test was conducted by using a total of seven conditioning disks (Example 1, Example 2, Comparative Example 1, Comparative Example 2, Comparative Example 3, Comparative Example 4 and Comparative Example 5), which are specified as follows:

Example 1 is identical with the above-described conditioning disk 1 of FIG. 1, wherein the ratio of the outside diameter of the radially inner portion of the metal substrate to the outside diameter of the metal substrate is 80%, while the difference amount between the thickness of the radially inner portion of the metal substrate and the thickness of the radially outer end of the metal substrate is equal to the average size of the abrasive grains.

Example 2 is identical with Example 1, except that the metal substrate further has the first and second grooves, as in the above-described conditioning disk 8 of FIG. 2.

Figure 4A:
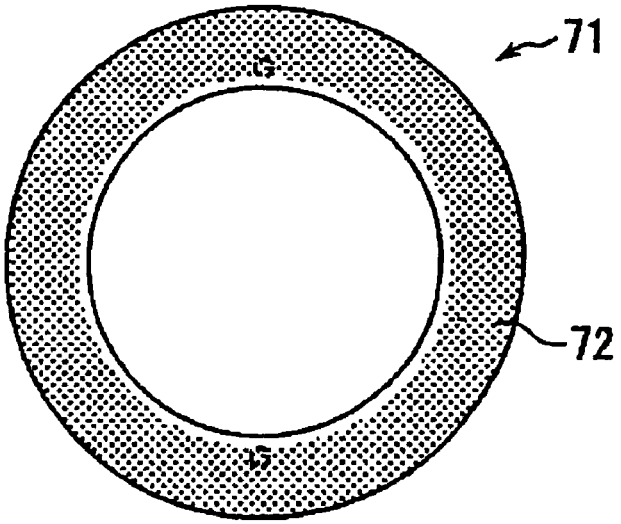
FIG.4A PRIOR ART
FIG. 4A is a view showing a conventional conditioning disk.
Figure 4B:
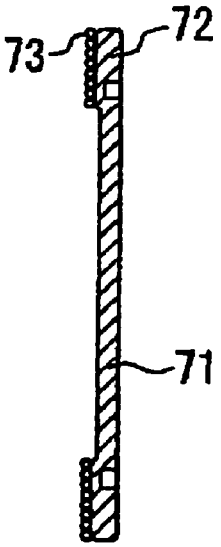
FIG.4B PRIOR ART
FIG. 4B is a cross sectional view of the conditioning disk of FIG. 4A.
Figure 5:
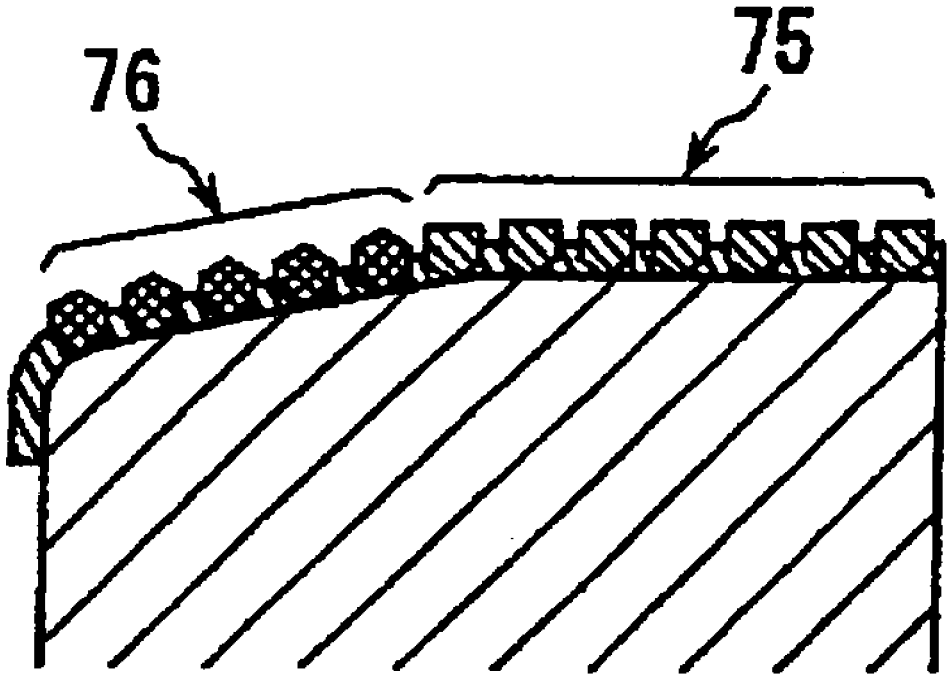
FIG.5 PRIOR ART
FIG. 5 is a cross sectional view of a part of another conventional disk.

Comparative Example 1 is identical with the above-described conventional conditioning disk shown in FIGS. 4A and 4B.

Comparative Example 2 is identical with the conditioning disk disclosed in JP-A-2001-113456, wherein super abrasive grains 75 each having obtuse cutting edges are fixed to a radially inside portion of the working surface of the disk-shaped metal substrate while super abrasive grains 76 each having sharp cutting edges are fixed to a radially outside portion of the working surface of the substrate.

Comparative Example 3 has substantially the same configuration as the conditioning disk 1 of FIG. 1, but is different from the conditioning disk 1 in that the ratio of the outside diameter of the radially inner portion of the metal substrate to the outside diameter of the metal substrate is 55%, while the ratio of the above-described difference amount to the average size of the abrasive grains is 160%.

Comparative Example 4 has substantially the same configuration as the conditioning disk 1 of FIG. 1, but is different from the conditioning disk 1 in that the ratio of the outside diameter of the radially inner portion of the metal substrate to the outside diameter of the metal substrate is 90%, while the ratio of the above-described difference amount to the average size of the abrasive grains is 60%.

Comparative Example 5 has substantially the same configuration as the conditioning disk 1 of FIG. 1, and is identical with the above-described Example 1 in that the above-described difference amount is equal to the average size of the abrasive grains, but is different from the above-described Example 1 in that the ratio of the outside diameter of the radially inner portion of the metal substrate to the outside diameter of the metal substrate is 80% or more and in that the radius of curvature of the curved surface of the transition portion between the non-inclined and inclined portions is 0.11 mm.

It is noted that the seven conditioning disks are the same in the outside diameter of the metal substrate and the grain size of the abrasive grains which are 100 mm and #100/120, respectively.

In the test, a pad conditioning operation was first carried out by using the above-described seven conditioning disks, under conditions as specified in Table 1. A wafer polishing operation was then carried out by using each polishing pad which had been conditioned by a corresponding one of the seven conditioning disk in the pad conditioning operation, under conditions which are the same as those specified in Table 1 except for the polishing time and used slurry. The wafer polishing operation was continued for one minute with use of W2000 as the slurry. A result of the polishing operation is shown in Table 2.

TABLE 1

| Used machine | Lapping machine |
|---|---|
| Number of revolutions of conditioning disk ($min^{-1}$) | 100 |
| Number of revolutions of rotary table ($min^{-1}$) | 100 |
| Load (1bf) | 6 |
| Polishing pad | IC1400 |
| Slurry | Pure water |
| Conditioning time (Hr) | 20 |

TABLE 2

| | Polishing rate (μm/Hr) | Pad lifetime (wafers) | Micro scratches |
|---|---|---|---|
| Example 1 | 150 | 130 | 50 |
| Example 2 | 180 | 150 | 35 |
| Comparative Example 1 | 100 | 100 | 100 |
| Comparative Example 2 | 110 | 105 | 95 |
| Comparative Example 3 | 120 | 105 | 90 |
| Comparative Example 4 | 110 | 110 | 95 |
| Comparative Example 5 | 130 | 105 | 90 |

Table 2 shows values in respective items (polishing rate, pad lifetime and micro scratches) in the wafer polishing operation with use of each of the polishing pads which were conditioned by the respective seven conditioning disks. In this Table 2, the value in each item in the polishing operation with use of one of the polishing pads, which was conditioned by the conditioning disk of Comparative Example 1, is set at 100 as a reference value.

In the pad conditioning operation, the damage of the abrasive grains in the radially outer portion was remarkably smaller in the conditioning disk of each of Examples 1 and 2 than in the conditioning disk of Comparative Example 1. Meanwhile, the abrasive grains in the radially outer end portion of the conditioning disk of each of Comparative Examples 2 and 3 were not brought into contact with the polishing pad. Further, the conditioning disks of each of Examples 1 and 2 exhibited a higher pad cut rate than the conditioning disk of each of Comparative Examples 2–5. The polishing pad conditioned by the conditioning disk of each of Examples 1 and 2 was satisfactorily flattened in its profile, without suffering from any local wear.

In the wafer polishing operation, the polishing pad conditioned by the conditioning disk of Example 2 exhibited the highest polishing rate, as is apparent from Table 2.

As is clear from the foregoing description, the present invention is advantageously applicable to a CMP pad conditioner which is used in a CMP apparatus for flattening a surface of a workpiece such as a wafer. The present invention restrains load from being concentrated to ones of the abrasive grains located in the radially outer portion of the disk-shaped disk, thereby making is possible to prevent wear, breakage and other damage of each of the abrasive grains. That is, the present invention contributes to prolongation in the lifetime of the conditioner and remarkable increase in the pad cut rate exhibited by the conditioner. Further, the conditioner constructed according to the present invention is capable of conditioning the CMP pad such that the conditioned CMP pad is given a high degree of flatness without suffering from any local wear. The CMP pad conditioned by the conditioner of the invention has a prolonged lifetime, and is given an increased capacity of transporting the slurry to the pad/wafer interface, thereby making it possible to remarkably reduce micro-scratches and other defects on the wafer.

While the presently preferred embodiments of the present invention have been illustrated above, it is to be understood that the invention is not limited to the details of the illustrated embodiments, but may be embodied with various other changes, modifications and improvements, which may occur to those skilled in the art, without departing from the spirit and scope of the invention defined in the following claims.

What is claimed is:

1. A conditioner for conditioning a CMP pad, comprising:

a disk-shaped substrate having a working surface which is provided by one of axially opposite end surfaces thereof and which is to be brought into contact with the CMP pad; and abrasive grains which are fixed to said working surface, wherein said substrate includes a radially inner portion and a radially outer portion which is located radially outwardly of said radially inner portion, wherein said working surface of said radially outer portion is inclined with respect to said working surface of said radially inner portion, such that a thickness of said radially outer portion as measured in an axial direction of said substrate is reduced as viewed in a direction away from an axis of said substrate toward a periphery of said substrate, and wherein a ratio of an outside diameter of said radially inner portion to an outside diameter of said substrate ranges between 60–85%.

2. The conditioner according to claim 1, wherein said abrasive gram are arranged in a predetermined pattern, and cooperate with each other to constitute an abrasive monolayer, and wherein said abrasive grains are bonded to said working surface of said disk-shaped substrate through a braze material including an active metal.

3. The conditioner according to claim 2, wherein said disk-shaped substrate is provided as an annular body, and wherein a ratio of an inside diameter of said radially inner portion to said outside diameter of said substrate is not larger than 45%.

4. The conditioner according to claim 1, wherein said working surface of said radially inner portion is parallel with a plane perpendicular to said axial direction of said disk-shaped substrate, such that a thickness of said radially inner portion as measured in said axial direction is substantially constant.

5. The conditioner according to claim 4, wherein said thickness of said radially inner portion of said disk-shaped substrate is larger than a thickness of a radially outer end of said disk-shaped substrate as measured in said axial direction, by a predetermined difference amount, and wherein a ratio of said predetermined difference amount to an average size of said abrasive grains ranges between 70–150%.

6. The conditioner according to claim 1, wherein said disk-shaped substrate further includes a radially intermediate portion which is interposed between said radially inner and outer portions in a radial direction of said disk-shaped substrate, and wherein said working surface of said radially intermediate portion is provided with a first curved surface which has a radius of curvature of at least 1 mm as measured in an axial cross section of said disk-shaped substrate.

7. The conditioner according to claim 6, wherein said working surface of said radially outer portion of said disk-shaped substrate is provided with a second curved surface which has a radius of curvature that is larger than said radius of curvature of said first curved surface.

8. The conditioner according to claim 7, wherein said radius of curvature of said second curved surface of said radially outer portion is larger than said outside diameter of said disk-shaped substrate.

9. The conditioner according to claim 1, wherein said abrasive grains fixed to said working surface of said disk-shaped substrate cooperate with each other to constitute an abrasive layer, and wherein said abrasive layer is divided into a plurality of segments by a plurality of grooves which are formed to extend along said working surface.

10. The conditioner according to claim 9, wherein said plurality of grooves includes first grooves each of which extends substantially in a circumferential direction of said disk-shaped substrate, and second grooves each of which extends in a direction away from said axis of said substrate toward said periphery of said substrate.

11. The conditioner according to claim 10, wherein said conditioner being rotated about said axis in a predetermined rotating direction for conditioning the CMP pad, and wherein each of said second grooves is inclined with respect to a radial direction of said disk-shaped substrate, such that a radially outer end of each said second grooves is positioned on a rear side of a radially inner end of said each of said second grooves as viewed in said rotating direction.

12. The conditioner according to claim 11, wherein each of said second grooves is curved such that a degree of inclination thereof with respect to said radial direction is gradually increased as viewed in said direction away from said axis of said disk-shaped substrate toward said periphery of said substrate.

* * * * *